US007570169B2

(12) United States Patent
Li et al.

(10) Patent No.: US 7,570,169 B2
(45) Date of Patent: Aug. 4, 2009

(54) ENVIRONMENTALLY SENSITIVE RECONFIGURABLE ANTENNA

(75) Inventors: Guann-Pyng Li, Irvine, CA (US); Mark Bachman, Irvine, CA (US)

(73) Assignee: The Regents of the University of California, Oakland, CA (US)

( * ) Notice: Subject to any disclaimer, the term of this patent is extended or adjusted under 35 U.S.C. 154(b) by 264 days.

(21) Appl. No.: 11/377,907

(22) Filed: Mar. 15, 2006

(65) Prior Publication Data

US 2006/0244606 A1 Nov. 2, 2006

Related U.S. Application Data

(60) Provisional application No. 60/662,161, filed on Mar. 15, 2005.

(51) Int. Cl.

| | |
|---|---|
| ***G08B 13/14*** | (2006.01) |
| ***H01Q 9/00*** | (2006.01) |
| ***H01Q 3/24*** | (2006.01) |
| ***H01Q 1/50*** | (2006.01) |

(52) U.S. Cl. ..... 340/572.7; 343/745; 343/876; 343/906

(58) Field of Classification Search ..... 343/700 MS, 343/745, 746, 749, 876, 906; 340/572.3
See application file for complete search history.

(56) References Cited

U.S. PATENT DOCUMENTS

| | | | | |
|---|---|---|---|---|
| 5,021,795 | A * | 6/1991 | Masiulis | 343/700 MS |
| 7,038,470 | B1 * | 5/2006 | Johnson | 324/664 |
| 7,151,455 | B2 * | 12/2006 | Lindsay et al. | 340/572.3 |
| 2007/0152829 | A1 * | 7/2007 | Lindsay et al. | 340/572.3 |

* cited by examiner

*Primary Examiner*—Shih-Chao Chen
(74) *Attorney, Agent, or Firm*—Orrick, Herrington & Sutcliffe LLP

(57) ABSTRACT

An antenna whose resonance and electromagnetic radiation properties can be modified by environmental conditions, acoustic conditions, and the like. The reconfiguring antenna acts to facilitate wireless transmission of information about the local environment without the need for local power.

12 Claims, 3 Drawing Sheets

ENVIRONMENTALLY SENSITIVE RECONFIGURABLE ANTENNA

CROSS-REFERENCE TO RELATED APPLICATIONS

This application claims the benefit of U.S. Provisional Application No. 60/662,161 filed Mar. 15, 2005, which application is incorporated herein by reference.

FIELD OF THE INVENTION

The present invention relates to antenna systems and, more particularly, to an antenna system that changes the nature of its transmission and reception of electromagnetic radiation based on local environmental conditions.

BACKGROUND OF THE INVENTION

With the exception of light-based sensors that change their light interaction properties, all sensors require some power in order to operate and provide a signal to a remote source. Light based systems are readily blocked by typical obstructions such as buildings, trees, and vegetation. Some wireless systems require the use of on-board circuitry that temporarily charges up a battery or capacitor in the presence of an externally applied RF radiation, then use this electrical energy to re-transmit signal. This method is bulky, expensive, and can only transmit data at short distances. The need for a powered sensor/transmitter severely limits the deployment of such sensors in large scale such as over large geographic regions or as part of the civil infrastructure.

Thus, it is desirable to provide a way to wirelessly transmit information about the local environment without the need for local power.

SUMMARY

The present invention provides an improved antenna whose resonance and electromagnetic radiation properties can be modified by environmental and acoustic conditions. The reconfiguring antenna acts to provide a way to transmit wireless information about the local environment without the need for local power.

The antenna is composed of a geometric pattern of conductive elements connected by one or more capacitive or resistive connections, herein called "connectors". The connectors contain small parts or elements that move or change their electrical property in the presence of an environmental factor, acoustic energy or the like, including, e.g., but not limited to, properties of the local environment such as chemical, biological, physical, temperature, humidity, shock, vibration, sound, pressure, strain, light; liquid, torque, and the like. These connector parts or elements can be cantilevers, bridges, membranes, and the like. The moving elements change the capacitance or resistance of the connections, thus changing the resonant frequency and resonant mode of the antenna system.

In certain embodiments, the environmentally sensitive connector is similar in technology to RF-MEMS switches. Other embodiments use solid-state connectors. The simplest exemplary embodiment comprises a small cantilever that is placed over conductive lines. The cantilever can be coated or partially composed of chemically sensitive material such that environmental conditions change the material properties of the material, thus changing the capacitance of the connector.

The changing configuration of the antenna can be used to passively and wirelessly couple the local environmental condition or local acoustic wave to a receiver. By sending electromagnetic radiation of known frequencies to the sensing antenna, one can monitor the absorbed or reflected radiation at one or more frequencies. The efficiency of absorption or reflection by the antenna will be modulated by the local environment or acoustic energy, thus affecting the monitored absorbed or reflected radiation. In this way, the environmental and acoustic information can be passively and wirelessly transmitted to an external source.

In operation, the environmentally controlled reconfigurable antenna can be used in, for example, (1) an acoustic sensor network for area surveillance, or (2) a bio-chemical-nuclear sensor network. Both examples, which are meant to be illustrative examples and not exhaustive of the types of useful devices that can be built with an environmentally sensitive reconfigurable antenna, comprise small devices, i.e., sensors or antennas, that monitor the environment and report the signal back to a receiver without the need for local power. One of skill in the art can readily recognize that the reconfigurable antenna can be used to build remote passive sensors for a multitude of applications, including, without limitation, remote detection of heat, vibration, light, movement, animal activity, and the like.

The sensor system advantageously requires no power, but can be interrogated remotely by wireless means. The simplicity of the device and passive operation means the device can be deployed over large regions while still enabling remote readout. Furthermore, since the interrogating system can use directional antennas, the interrogating radiation can be highly localized, e.g., through the use of a "pencil beam". Thus the location of the sensors can be determined by the interrogating system, allowing true geographic mapping of the sensor networks.

In another preferred embodiment, the antenna or circuitry of an RFID (radio frequency identification) system is utilized. Passive RFID devices re-radiate energy from an interrogating beam to provide information about the RFID device.

Further systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. It is also intended that the invention is not limited to the details of the example embodiments.

BRIEF DESCRIPTION OF THE DRAWINGS

The details of the invention, both as to its structure and operation, can be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes can be illustrated schematically rather than literally or precisely.

DESCRIPTION OF THE PREFERRED EMBODIMENT

Figure 1:
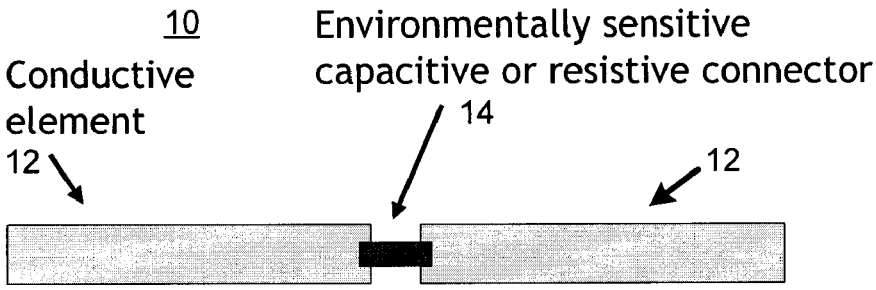
FIG. 1 is a schematic of an environmentally sensitive reconfigurable antenna.

Referring in detail to the figures, the systems and methods described herein facilitate the wireless transmission of information about the local environment without the need for local power. Turning to FIG. 1, a environmentally sensitive reconfigurable antenna 10, as depicted, includes a geometric pattern of conductive elements 12 connected by one or more capacitive or resistive connectors 14. The conductive elements 12 and connectors 14, as illustrated, are arranged in dipole configuration. The capacitive or resistive connectors 14 contain small parts that change their electrical property or move as a result of change of conditions in the local environment or in the presence of acoustic energy. The changing environmental conditions cause a change in the electrical property of the connections 14, thus changing the resonant frequency and resonant mode of the antenna system 10.

Figure 2:
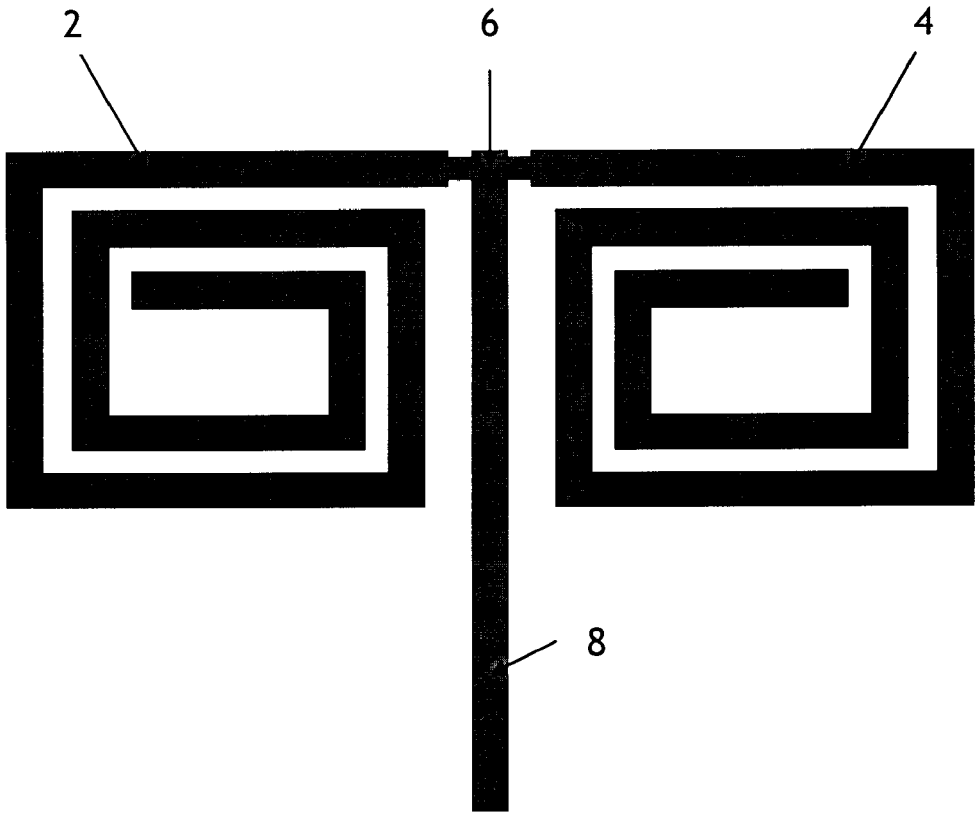
FIG. 2 is a schematic of an example of an environmentally sensitive reconfigurable antenna designed to resonate in left or right circular polarizations.

Referring to FIG. 2, an example is provided of an antenna designed to resonate in left or right circular polarizations depending on the state of the coupling device shown at the center. The antenna includes a first radiating part 2 designed to radiate in a left-polarization manner and a second radiating part 4 designed to radiate in a right polarization manner. The radiating parts 2 and 4 are electrically coupled by a device 6 to the remainder of the resonating circuit 8. The coupling device 6 provides electrical connectivity between one or both sides of the circuit that is efficient at the frequencies of interest. This device can change its efficiency of coupling to one or both sides of the antenna 2 and 4 depending the state environment. If the device changes its coupling efficiency, the antenna will reflect back a different amount of power than during its initial state. This can be taken as a measure of a change in the environment.

Figure 3:
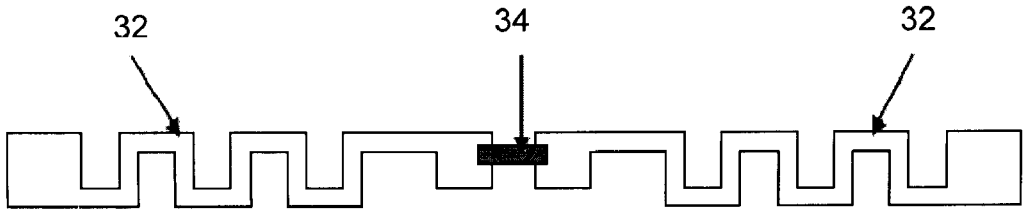
FIG. 3 is a schematic of an example of a dipole type environmentally sensitive reconfigurable antenna.

An example of a dipole type antenna is shown in FIG. 3. As depicted, a dipole antenna geometry is constructed from a conducting element 32. The antenna is coupled at its center by an environmentally sensitive coupling device 34. The coupling device 34 changes its coupling efficiency in response to an environmental state. This will change the efficiency of the dipole antenna to radiate energy, thus changing the efficiency of reflected power. A change in reflected power can be interpreted to be a change in the state of the environment.

Figure 4:
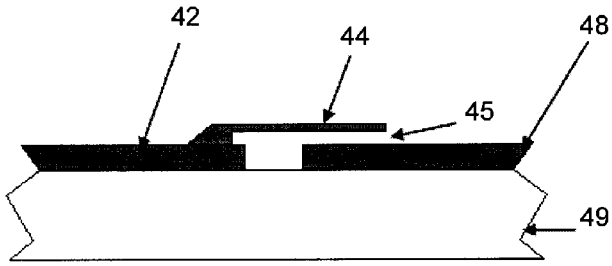
FIG. 4 is a schematic of an example of an environmentally sensitive coupling device having a conductive cantilever capacitor.

Turning to FIG. 4, an example of an environmentally sensitive coupling device is shown. A first and second parts of a resonant circuit are constructed using electrically conductive material. The first part of the resonant circuit 42 is connected to a second part of the resonant circuit 48 by a thin conductive cantilever capacitor 44. The entire device rests on a support structure 49. At an appropriate radio frequency, the cantilever capacitor 44 provides electrical coupling between the two parts of the resonant circuit. The circuit can be used to reflect power back from an RF source. If the cantilever 44 is moved, for example due to vibrations or acoustic energy, the capacitance will change because the gap 45 between the cantilever and one of the circuit parts will change. Thus, the coupling between the two parts of the resonant circuit is modulated, resulting in a modulation in the efficiency of the resonant circuit, and the reflected power from an external source will be correspondingly modulated.

The cantilever can be made from a plurality of materials, including those that change stress in the presence of environmental changes. For example, the cantilever could be constructed from a bimetallic strip, making it move when the temperature changes. Or the cantilever could be constructed from metal coated polymer that bends when the humidity changes.

Figure 5:
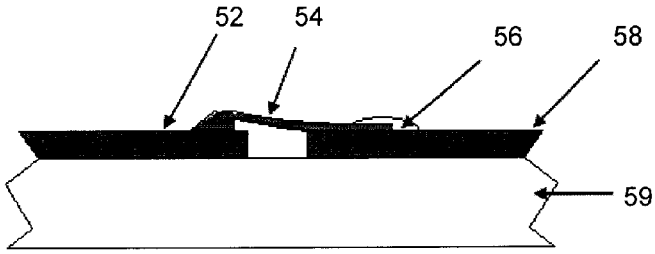
FIG. 5 is a schematic of an example of an environmentally sensitive coupling device with latching capability.

Referring to FIG. 5, an example of an environmentally sensitive coupling device with latching capability is shown. As depicted, a resonant circuit is constructed using electrically conductive material. The first part of the resonant circuit 52 is connected to a second part of the resonant circuit 58 by a thin metal strip 54 that is bent down to make electrical contact with the second conductor. The strip is held in contact by a material 56 that acts as a bonding device. The entire device rests on a support structure 59. Under certain environmental conditions, the bonding material 56 will lose its bonding property. For example, the bonding material may melt above a certain temperature or may breakdown in the presence of certain chemicals, UV light, or humidity. In all cases, the metal strip 54 will then be free to move away from the second conductor 58. This will result in an open circuit between the two parts of the resonant circuit, thus modifying the efficiency of a reflected RF signal. This can be readily interpreted as a change in the state of the environment.

Figure 6:
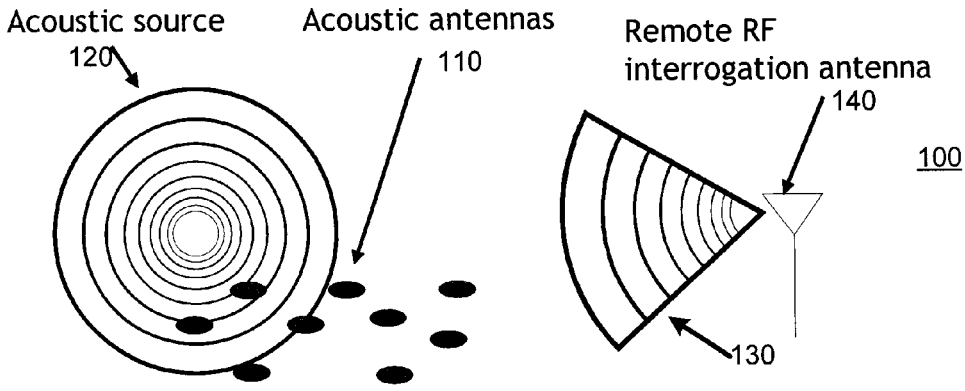
FIG. 6 is a schematic of an acoustic sensor network.

One of skill in the art would readily recognize that the environmentally sensitive reconfigurable antenna can be used to build remote passive sensors for a multitude of applications, including, but not limited to, remote detection of chemical, biological, physical, temperature, heat, humidity, shock, vibration, movement, sound, pressure, strain, light, liquid, torque, animal activity, and the like. In one embodiment, which is provided as an example and not to limit the invention, an acoustic sensor network 100, as depicted in FIG. 6, comprises a plurality of acoustic antennas 110 for remote readout of large areas by radio-frequency interrogation. The small acoustic antennas (sensors) 110 are distributed over the geographic region of interest. An interrogating antenna 140 directs RF excitation energy 130 to the small sensors 110. The sensors 110 reflect energy back based on the acoustic energy 120 they experience. The interrogation antenna 140 then extracts the acoustic information based on the amount and frequency of reflected radiation. If the interrogating antenna 140 is directional, the location of the sensor 110 can be readily identified.

In the acoustic sensor network 100, the small antennas 110 are made with acoustically sensitive capacitors. The capacitors are made from thin, movable conductive structures (e.g., cantilevers, bridges, membranes) that are in close proximity to a second conductive material. When the movable conductive structures experience acoustic energy, they move in response to the acoustic wave. This changes the coupling between antenna elements, thereby changing the radiation modes of the acoustic antenna system 100.

Many acoustic antennas 110 can be deployed over a large geographic area, such as over land or under sea, or in urban areas such as along streets, in or on bridges and buildings. The antennas 110 can be housed in shells that provide protection and also serve to camouflage the antennas. Once deployed, the antennas 110 can be monitored remotely by wireless systems, such as, for example, an RF interrogation antenna 140, that monitor the changing frequency patterns of the antennas 110. The acoustic sensors 110 advantageously do not require power. In this way, one can monitor large areas for acoustic activity, such as for security or other applications. Sensor geo-acoustic patterns can be further analyzed to determine the nature of the sound sources, such as monitoring vehicle traffic.

Since each sensor can produce broadband frequency modulations at rates of up to several thousand Hertz, collecting information from many acoustic sensors over a large region can be difficult. The acoustic signal can be simplified for presentation to the wireless collection system preferably by providing mechanically resonating elements in the capacitive links (see FIG. 1, connector 14) of the acoustic antenna. Each mechanical resonator preferably responds primarily to only one frequency. Using a single mechanically resonant element in an antenna will select only a sub band of the acoustic spectrum. Thus, only this sub band is used to modulate the antenna performance, and only this sub band is detected by the remote system. Since the signal is pre-filtered, the sensor collection can be simplified to geographic scans at different frequencies. In this way, for example, an acoustic antenna system can have one antenna mode for one acoustic frequency, and another antenna mode for a second acoustic frequency. Thus, different acoustic frequencies are carried on different RF bands. So the remote system can scan acoustic frequencies by scanning different RF bands, thus building up an acoustic signature for each sensor.

Figure 7:
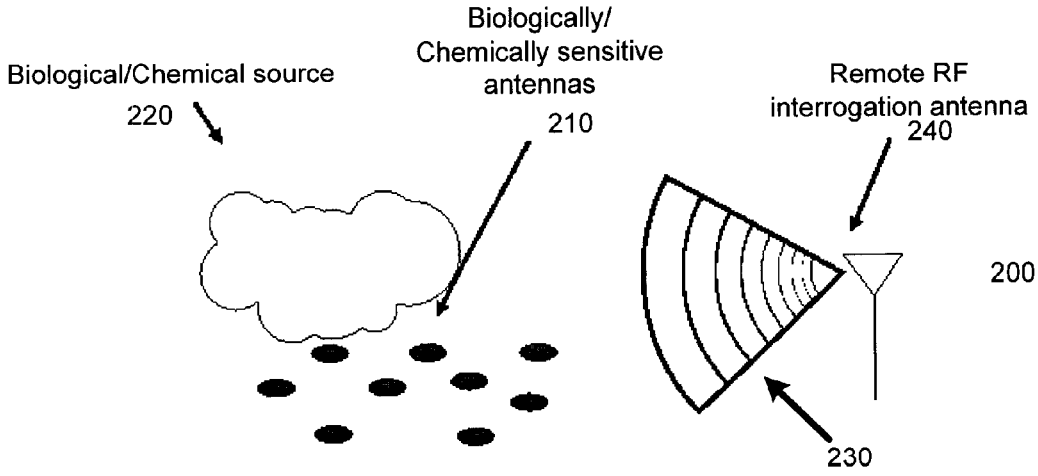
FIG. 7 is a schematic of a biological or chemical sensor network.

In another embodiment, which is provided as an example and not to limit the invention, a chemical or biological sensor network 200, as depicted in FIG. 7, comprises a plurality of chemically sensitive reconfigurable antennas 210 for remote readout of large areas by radio-frequency interrogation. The small chemically sensitive antennas (sensors) 210 are distributed over the geographic region of interest. An interrogating antenna 240 directs RF excitation energy 230 to the small sensors 210. The sensors 210 reflect energy back based on the chemical conditions 220 they experience. The interrogation antenna 240 then extracts the chemical information based on the amount and frequency of reflected radiation. If the interrogating antenna 240 is directional, the location of the sensor 210 can be readily identified.

In the chemical and biological sensor network 200, the small antennas 210 are made with chemically sensitive capacitors or conductive switching elements. The antennas are dispersed over a geographic region and monitored remotely by radio system that directs RF radiation at the chemical sensor network and receives reflected radiation from the antennas. The capacitors or conductive switching elements can be made chemically or biologically sensitive in a multiple ways.

In one embodiment of the chemically sensitive reconfigurable antenna 210, a dielectric material is placed between two conductive elements, forming the connector (14, FIG. 1). The dielectric material is designed to absorb specific chemical or biological species, and then change its dielectric constant as a result. In this way, the presence of the chemical species will change the capacitance, and the change in capacitance changes the radiation property of the antenna 210.

In a second embodiment of the chemically sensitive reconfigurable antenna 210, the connector (14, FIG. 1) is made from a first conductive material in close proximity to a second conductor, forming a capacitor. The first conductive material is coated by a chemically reactive surface designed to adsorb specific biological or chemical species. When the new species are adsorbed, the first conductor experiences a stress and changes its position with respect to the second conductor, thereby changing the capacitance of the antenna connector, and changing the radiation properties of the antenna. In some cases, the moving conductor can form a complete electrical connection, so that the coupling becomes a completed circuit.

In a third embodiment of the chemically sensitive reconfigurable antenna 210, the sensing element can be made with a material that corrodes in the presence of the chemical of biological species of interest. The material can be conductive or dielectric, and it can form a capacitive or resistive bridge between two or more conductors in the antenna. The presence of certain chemical or biological species causes the material to corrode, thereby changing the capacitance or resistance of the connector. In some cases the corroded material can allow a spring loaded element to short or open between two conductors.

The use of multiple capacitive elements with different chemical affinities can be used to monitor multiple chemical species. The connectors can be placed strategically at different points on the antenna. In this way, a single antenna can be used to monitor multiple chemical and biological species at once. Furthermore, the signal for different chemical and biological detections shows up as different antenna responses.

Detection of nuclear radiation can be accomplished similarly through the use of materials that degrade or change their electrical performance after exposure to alpha, beta, gamma, X-ray or ultraviolet radiation.

The bio/chem/nuclear sensitive antenna network 200 can be monitored similarly to the acoustically sensitive antenna network 100. A remote transmitter sends a radiation pattern towards the sensor network. The reflected or absorbed radiation is modified by the status of the antenna elements.

In another embodiment, the present invention is utilized with the antenna or circuitry of an RFID (radio frequency identification) system. Passive RFID devices re-radiate energy from an interrogating beam to provide information about the RFID device. Active RFID systems use on-board power to radiate information about the RFID device. The present invention can change the nature of this radiation by changing the electrical properties of the radiator, usually an antenna, or the electrical properties of the RFID chip itself. Hence, in this embodiment information can be added about a sensor state to the RFID information that is normally transmitted. In the simplest embodiment, the sensor state information can be attached or added to an RFID bar code. For example, a passive sensor could be constructed that changes the electrical property of an antenna or connected radiating circuit when, e.g., the temperature or some other environmental condition exceeds a certain value. The device would then provide information about temperature along with bar code on an RFID system. In operation, the sensor device could change the over-all resonant central frequency of the antenna, or it could change the polarization state of the antenna, or could change the efficiency of the antenna. The sensor could be used with multiple RFID chips or multiple radiating circuits to provide redundant information, control information, or high fidelity information, or information from multiple sensors.

In one example, a temperature sensitive passive RFID device was constructed using two RFID chips connected to one antenna. One of the RFID chips was connected to a tiny metal strip that was held in place by a low temperature wax. When the temperature of the wax exceeded a nominal value (~50 C), it melted. This allowed the metal strip to bend up and open the circuit to the second RFID chip. This change could be monitor directly using an RFID reader which would read back two ID codes, followed by only one ID code after the critical temperature was reached.

Figure 8:
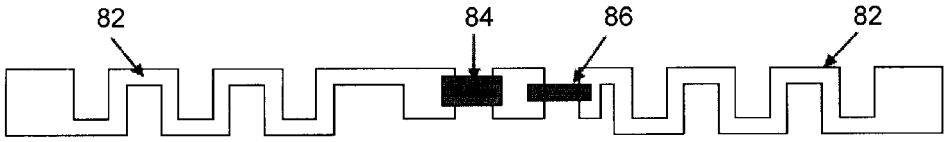
FIG. 8 is a schematic of an example of use of an environmentally sensitive coupling device with a standard RFID system

An example of the use of an environmentally sensitive coupling device with a standard RFID system is shown in FIG. 8. The RFID system includes an antenna 82 and an RFID chip 84. The first and second parts of the antenna 82 are connected by an environmentally sensitive coupling device 86. An external reader is used to energize the RFID chip 84 and receive data that is re-radiated back from the REID system. If the electrical coupling provided by the coupling device is good, then the REID chip data will be efficiently read back by the reader. If the coupling is poor, the RFID chip data will not be read back. Similar configurations can be used to change the center frequency of the RFID read back or the polarization of the RFID readback.

Figure 9:
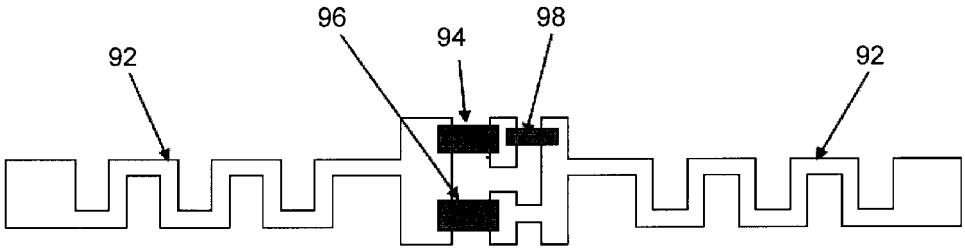
FIG. 9 is a schematic of an example of the use of an environmentally sensitive coupling device with two standard RFID chips.

Turning to FIG. 9, an example of the use of an environmentally sensitive coupling device with two standard RFID chips is shown. The RFID system includes an antenna 92 and first and second RFID chips 94 and 96. The second RFID chip 96 is connected to both parts of the antenna 92. The first RFID chip 4 is connected directly to a first part of the antenna 92 and by an environmentally sensitive coupling device 98 to the second part of the antenna 92. An external reader is used to energize the RFID chips and receive data that is re-radiated back from the RFID system. If the electrical coupling provided by the coupling device is good, then the REID chip data from both chips will be efficiently read back by the reader. If the coupling is poor, the RFID chip data from only the second REID chip 96 will not be read back. In this manner, the state change of the coupling device 98 can be remotely measured.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit of the disclosure. Furthermore, it should also be understood that the features or characteristics of any embodiment described or depicted herein can be combined, mixed or exchanged with any other embodiment.

What is claimed:

1. An environmentally sensitive reconfigurable antenna comprising first and second conductive elements, and a connector coupling the first conductive element to the second conductive element, the connector have an electric property alterable in response to a change in environmental conditions, wherein the environmental conditions include the presence of a biological agent, a chemical agent, a nuclear radiation, and/or acoustic energy, wherein the connector is a capacitive connector, wherein the capacitive connector includes movable acoustically sensitive capacitive elements.

2. The antenna of claim 1 wherein the capacitive connector further includes a mechanical resonator.

3. An environmentally sensitive reconfigurable antenna comprising first and second conductive elements, and a connector coupling the first conductive element to the second conductive element, the connector have an electric property alterable in response to a change in environmental conditions, wherein the connector is a capacitive connector, wherein the capacitive connector includes a dielectric material placed between two conductive elements to form a capacitor, wherein the dielectric constant of the dielectric material changes upon absorption of a predetermined chemical species changing capacitance of the capacitor.

4. The antenna of claim 3 wherein the predetermined chembical species is a predetermined biological and the dielectric constant of the dielectric material changes upon absorption of the predetermined biological species changing capacitance of the capacitor.

5. An environmentally sensitive reconfigurable antenna comprising first and second conductive elements, and a connector coupling the first conductive element to the second conductive element, the connector have an electric property alterable in response to a change in environmental conditions, wherein the connector is a capacitive connector, wherein the capacitive connector includes a first conductive material and a second conductive material forming a capacitor, the first conductive material being coated with a chemically reactive material adapted to absorb a predetermined chemical species, wherein the first conductive material experiences stress upon absorption of the predetermined chemical species by the reactive material changing the position of the first conductive material relative to the second conductive material changing the capacitance of the capacitor.

6. The antenna of claim 5 wherein the chemically reactive material is a biologically reactive material adapted to absorb a predetermined biological species, wherein the first conductive material experiences stress upon absorption of the predetermined biological species by the reactive material changing the position of the first conductive material relative to the second conductive material changing the capacitance of the capacitor.

7. An environmentally sensitive reconfigurable antenna comprising first and second conductive elements, and a connector coupling the first conductive element to the second conductive element, the connector have an electric property alterable in response to a change in environmental conditions, wherein the connector is a resistive connector wherein the connector includes a material that is corrodable in the presence of a predetermined chemical species changing resistance of the connector.

8. The antenna of claim 7 wherein the predetermined chemical species is a predetermined biological species.

9. An environmentally sensitive reconfigurable antenna comprising first and second conductive elements, and a connector coupling the first conductive element to the second conductive element, the connector have an electric property alterable in response to a change in environmental conditions, wherein the connector is a capacitive connector, wherein the connector includes a material that is corrodable in the presence of a predetermined chemical species changing capacitance of the connector.

10. The antenna of claim 9 wherein the predetermined chemical species is a predetermined biological species.

11. An environmentally sensitive reconfigurable antenna comprising first and second conductive elements, and a connector coupling the first conductive element to the second conductive element, the connector have an electric property alterable in response to a change in environmental conditions, wherein the connector is a resistive connector, wherein the connector includes a material whose electrical performance changes after exposure to nuclear radiation.

12. An environmentally sensitive reconfigurable antenna comprising first and second conductive elements, and a connector coupling the first conductive element to the second conductive element, the connector have an electric property alterable in response to a change in environmental conditions, wherein the connector is a capacitive connector, wherein the connector includes a material whose electrical performance changes after exposure to nuclear radiation.

* * * * *